US009039458B2

(12) United States Patent
Tsuchiya

(10) Patent No.: US 9,039,458 B2
(45) Date of Patent: May 26, 2015

(54) MINIATURIZATION CONNECTOR ASSEMBLY

(75) Inventor: Kazuhiko Tsuchiya, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 10 days.

(21) Appl. No.: 13/808,657

(22) PCT Filed: Aug. 31, 2011

(86) PCT No.: PCT/JP2011/069783

§ 371 (c)(1),
(2), (4) Date: Jan. 7, 2013

(87) PCT Pub. No.: WO2012/029856

PCT Pub. Date: Aug. 3, 2012

(65) Prior Publication Data

US 2013/0109247 A1 May 2, 2013

(30) Foreign Application Priority Data

Aug. 31, 2010 (JP) ..... 2010-194470

(51) Int. Cl.
*H01R 13/502* (2006.01)
*H01R 24/20* (2011.01)
*H01R 13/436* (2006.01)

(52) U.S. Cl.
CPC ..... *H01R 24/20* (2013.01); *H01R 13/4365* (2013.01)

(58) Field of Classification Search
USPC ..... 439/686, 689, 682, 701
IPC ..... H01R 13/506,13/516, 13/424, 23/02, H01R 24/76
See application file for complete search history.

(56) References Cited

U.S. PATENT DOCUMENTS 5,362,261 A * 11/1994 Puerner ..... 439/752
5,607,327 A 3/1997 Tsuji et al.
6,231,398 B1 * 5/2001 Furutani et al. ..... 439/701
7,488,220 B2 * 2/2009 Suzuki ..... 439/752

(Continued)

FOREIGN PATENT DOCUMENTS

CN 1232304 A 10/1999
CN 101202391 A 6/2008
JP 7-34570 U 6/1995

(Continued)

OTHER PUBLICATIONS

International Search Report (PCT/ISA/210), dated Oct. 25, 2011, issued by the International Searching Authority in corresponding International Application No. PCT/JP2011/069783.

(Continued)

*Primary Examiner* — Hien Vu
(74) *Attorney, Agent, or Firm* — Sughrue Mion, PLLC

(57) ABSTRACT

A connector is provided, which can seek miniaturization by suppressing external form dimensions of an inner housing. The connector includes, as means for engaging and uniting housing division bodies 20 and 30 that constitute the inner housing 10, engagement pieces 22 equipped on one side of the housing division bodies and inserted between adjacent terminal accommodation portions 13 in the other side of the housing division bodies, and locking portions equipped between the terminal accommodation portions 13 in the other side of the housing division bodies and engaged with the inserted engagement pieces to make the housing division bodies 20 and 30 in a connection state.

2 Claims, 5 Drawing Sheets

(56) References Cited

U.S. PATENT DOCUMENTS

| | | | | |
|---|---|---|---|---|
| 8,597,062 | B2 * | 12/2013 | Casses et al. | 439/686 |
| 2008/0119075 | A1 | 5/2008 | Suzuki | |

FOREIGN PATENT DOCUMENTS

| | | | |
|---|---|---|---|
| JP | 8-17511 | A | 1/1996 |
| JP | 11-339891 | A | 12/1999 |
| JP | 2002-334740 | A | 11/2002 |
| JP | 2002-343482 | A | 11/2002 |
| JP | 2008-153055 | A | 7/2008 |

OTHER PUBLICATIONS

Written Opinion (PCT/ISA/237), dated Oct. 25, 2011, issued by the International Searching Authority in corresponding International Application No. PCT/JP2011/069783.

Office Action dated Jul. 8, 2014, issued by the Japanese Patent Office in counterpart Japanese Patent Application No. 2010-194470.

Chinese Office Action dated Sep. 18, 2014 issued by The State Intellectual Property Office of the People's Republic of China in counterpart Chinese Application No. 201180042130.6.

* cited by examiner

MINIATURIZATION CONNECTOR ASSEMBLY

TECHNICAL FIELD

The present invention relates to a connector which includes an inner housing that is assembled in a structure in which a plurality of terminal accommodation portions are penetratingly formed in a connector fitting direction by an engagement union of a plurality of housing division bodies and an outer housing that is fit into the inner housing to cover the circumference of the inner housing.

BACKGROUND ART

FIG. 5 illustrates a connector disclosed in Patent Document 1 below.

A connector 101 illustrated in FIG. 5 is a connector to connect a shield electric wire, and includes an inner housing 110 and an outer housing 140.

The shield electric wire 103 is configured to have two signal lines 104 and drain lines 105 for ground connection.

The inner housing 110 is assembled in a structure in which a plurality of terminal accommodation portions 113 are penetratingly formed along a connector fitting direction (direction of an arrow X in FIG. 5) by an engagement union of two housing division bodies 121 and 131.

In the case of the inner housing 110 of the illustrated example, the housing division body 121 is a housing main body in which an upper pan of a base end side that becomes an insertion side of the shield electric wire 103 is assumed as an opening portion 122. In the opening portion 122, base end sides 113*a* of the plurality of terminal accommodation portions 113 are exposed in the form of a plurality of grooves. On the base end side 113*a* of each terminal accommodation portion 113, pressure welding terminals that connect the signal lines 104 and the drain lines 105 to pressure welding beforehand are mounted, and by inserting the signal lines 104 and the drain lines 105 into the corresponding pressure welding terminals, the shield electric wire 103 is connected to the respective pressure welding terminals.

In the case of the illustrated example, the other housing division body 131 that is engaged with and united to the housing division body 121 is a cover member that openably covers the opening portion 122. As the housing division body 131 covers the opening portion 122 of the housing division body 121, the signal lines 104 and the drain lines 105 that are connected to respective pressure welding terminals are pressingly fixed into each terminal accommodation portion 113.

In the case of the illustrated example, as means for engaging and uniting the housing division body 121 and the housing division body 131 to each other, engagement pieces 133 equipped in the housing division body 131 and locking portions 127 equipped in the housing division body 121 are provided.

The engagement piece 133 includes elastic wall portions 133*a* installed to hang down from both side edges of the housing division body 131 and engagement projection portions installed to project from the front ends of the elastic wall portions 133*a*. The elastic wall portions 133*a* extend to overlap inner surfaces of both side walls 124 and 125 of the housing division body 121 that is the housing main body.

The locking portions 127 are notches that are formed on the both side walls 124 and 125 of the housing division body 121 so that the engagement projection portions 133*b* are engaged with the locking portions 127.

The outer housing is approximately in a square tube shape, and is formed of a metal plate. The outer housing 140 is mounted on and fit in the inner housing 110 so as to cover the circumference of the inner housing 110. In the outer housing 140, an elastic contact piece 141 is integrally formed to project from the side wall portion to the inside of the outer housing 140. Since the elastic contact piece 141 is in contact with a drain terminal of the housing division body 121 from a notched window 129 formed on the side of the housing division body 121, it has the same electric potential as the drain terminal and electromagnetically shields the circumference of the housing division body 121.

PRIOR ART DOCUMENT

Patent Documents

[Patent Document 1] JP-A-H11-339891

SUMMARY OF INVENTION

Problems to be Solved by Invention

According to the connector 101 described in Patent Document 1 as described above, the engagement pieces 133 and the locking portions 127, which are means for engaging and uniting the housing division body 121 and the housing division body 131 to each other, are installed on both outer portions of the respective housing division bodies. Through this, the width dimensions of the inner housing 110 become a value that is obtained by adding the width dimensions necessary for engagement of the engagement pieces 133 with the locking portions 127 to both sides of the width dimensions necessary for arrangement of the plurality of terminal accommodation portions 113. Accordingly, for the equipment of the engagement pieces 133 and the locking portions 127, the external form dimensions (width dimensions) of the inner housing 110 increase, and as a result, the connector itself becomes large-sized.

An object of the present invention is to solve the above-described problems, and to provide a connector which can seek miniaturization by suppressing the external form dimensions of the inner housing.

Means for Solving Problems

The object of the present invention as described above can be achieved by the following configuration.

(1) A connector including an inner housing that is assembled in a structure in which a plurality of terminal accommodation portions are penetratingly formed in a connector fitting direction by an engagement union of a plurality of housing division bodies, and an outer housing that is configured to be fit into the inner housing to cover a circumference of the inner housing, wherein the connector further comprises, as means for engaging and uniting the housing division bodies: engagement pieces equipped on one of the housing division bodies to be engaged and united and inserted between adjacent terminal accommodation portions in the other of the housing division bodies; and locking portions equipped between the terminal accommodation portions in the other of the housing division bodies and engaged with the inserted engagement pieces to make the housing division bodies in a connection state.

(2) The engagement pieces and the locking portions may be provided in a plurality of places that are shifted in the fitting direction of the housing division bodies to be engaged and united.

According to the configuration of (1), the engagement pieces and the locking portions, which are the means for engaging and uniting the housing division bodies, complete the engagement in a space between the adjacent terminal accommodation portions in the respective housing division bodies.

Accordingly, it is not necessary that the width dimensions of the inner housing is obtained by adding the width dimensions necessary for the engagement of the engagement pieces with the locking portions to both outer sides of the width dimensions necessary for the arrangement of the plurality of terminal accommodation portions. Through this, miniaturization of the connector can be sought by suppressing the external form dimensions of the inner housing.

According to the configuration of (2), since the engagement pieces and the locking portions are engaged in the plurality of places, the bond strength of the housing division bodies can be improved. Further, since the plurality of engagement places are shifted in the fitting direction of the housing division bodies, the insertion force that is necessary at the time of the fitting of the housing division bodies can be reduced to improve the assembling characteristics of the inner housing.

EMBODIMENTS OF INVENTION

Hereinafter, a connector according to a preferred embodiment of the present invention will be described in detail with reference to the drawings.

Figure 1:
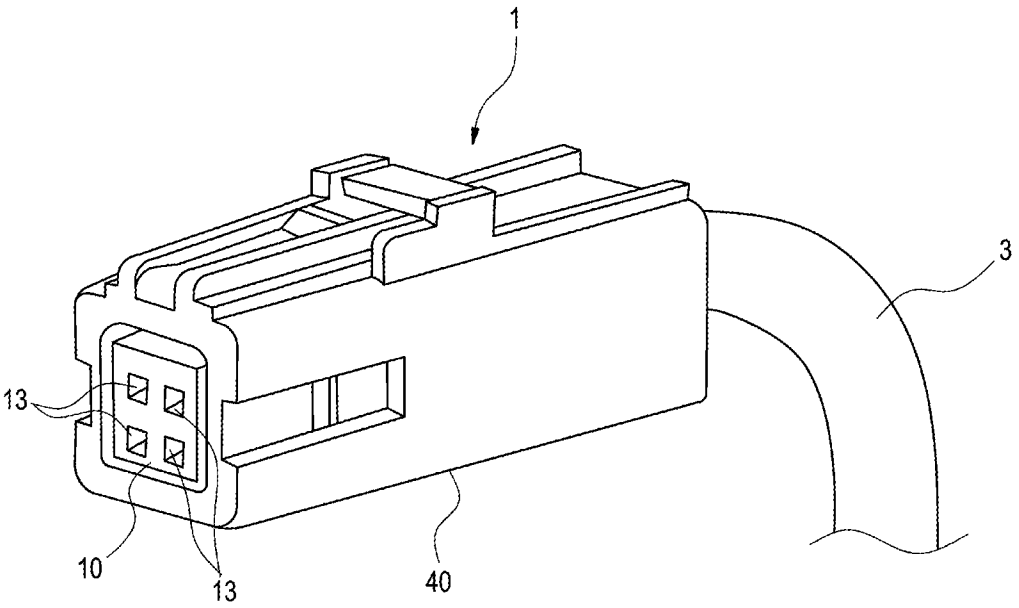
FIG. 1 is a perspective view illustrating the assembled state of a connector according to an embodiment of the present invention.
Figure 2:
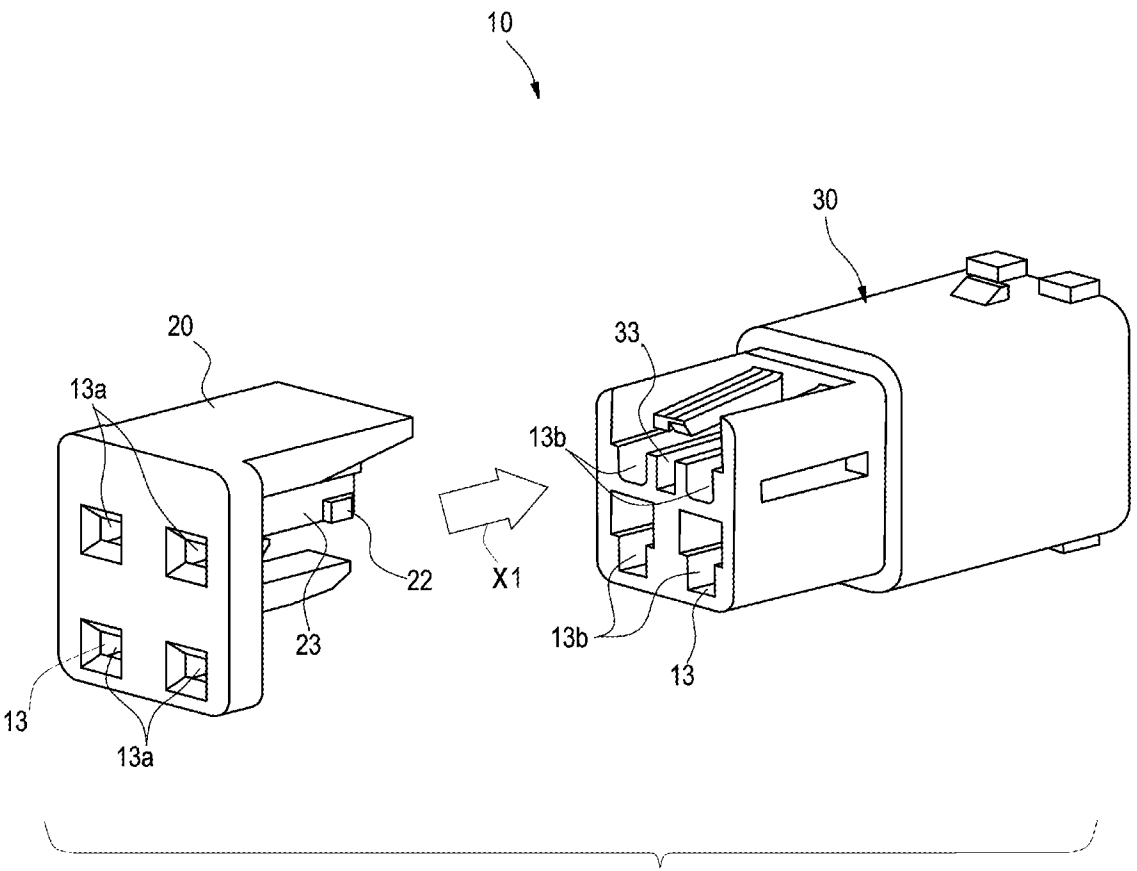
FIG. 2 is an exploded perspective view of an inner housing in the connector of FIG. 1.
Figure 3:
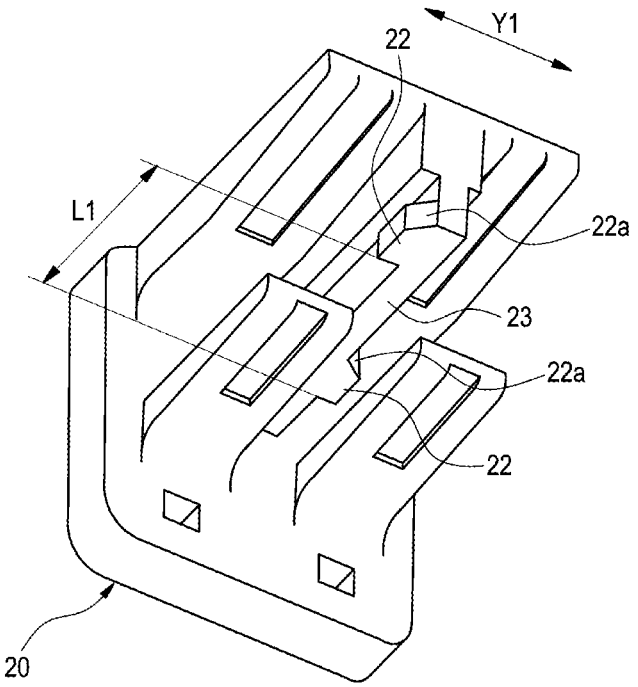
FIG. 3 is a perspective view illustrating the arrangement of engagement pieces equipped in the first housing division body of FIG. 2.
Figure 4:
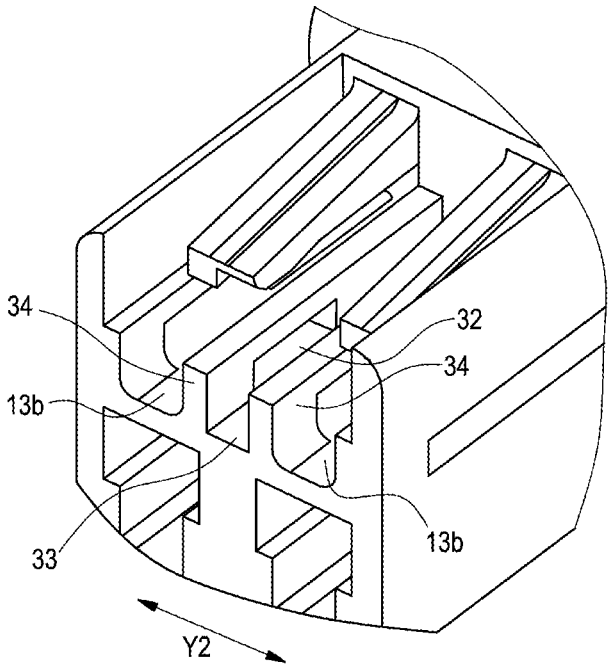
FIG. 4 is a perspective view illustrating the arrangement of locking portions equipped in the second housing division body of FIG. 2.
Figure 5:
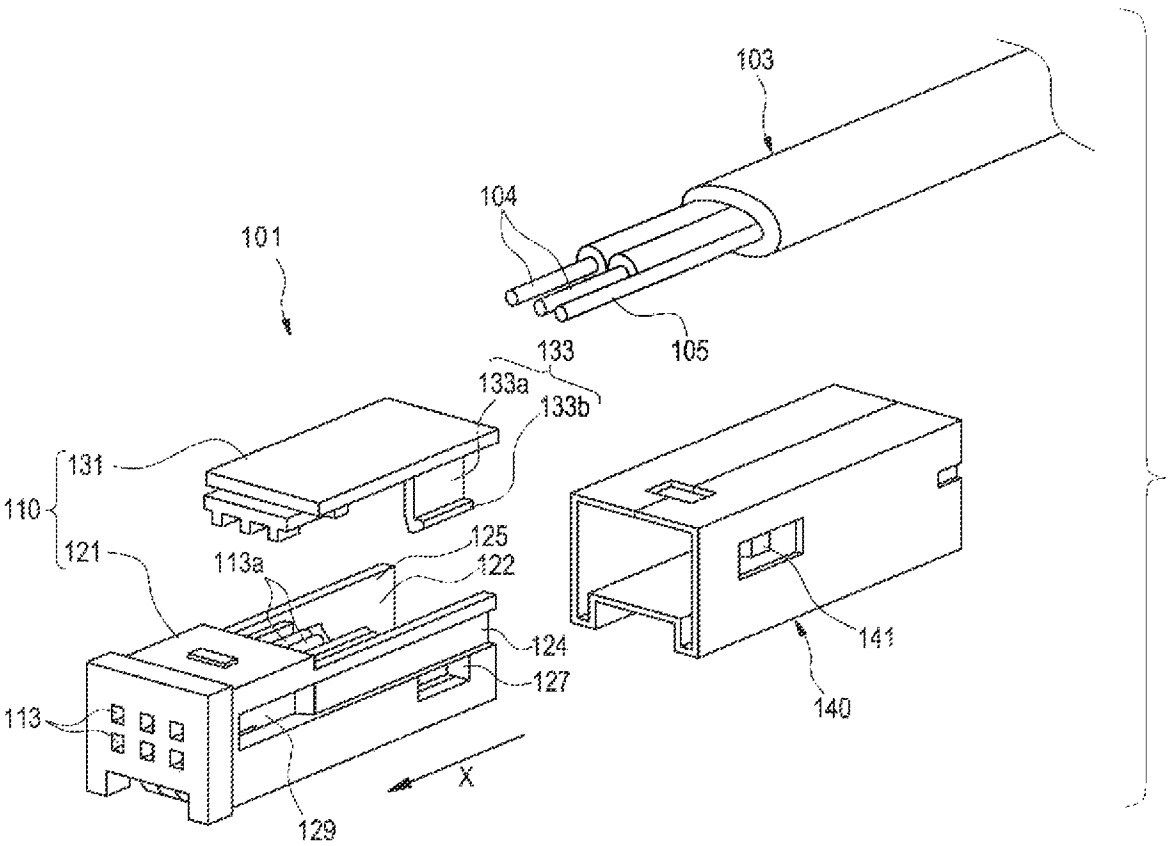
RELATED ART FIG.5
FIG. 5 is an exploded perspective view of a connector in the related art.

FIGS. 1 to 4 illustrate a connector according to an embodiment of the present invention. FIG. 1 is a perspective view illustrating the assembled state of a connector according to an embodiment of the present invention. FIG. 2 is an exploded perspective view of an inner housing in the connector of FIG. 1. FIG. 3 is a perspective view illustrating the arrangement of engagement pieces equipped in the first housing division body of FIG. 2, and FIG. 4 is a perspective view illustrating the arrangement of locking portions equipped in the second housing division body of FIG. 2.

A connector 1 according to an embodiment of the present invention is a 4-pin shield connector based on the IEEE 1394 standard, and as illustrate in FIG. 1, includes an inner housing 10 that accommodates and holds connection terminals (not illustrated) connected to signal lines and drain lines of a shield wire 3 and an outer housing 40 that covers the circumference of the inner housing 10.

As illustrated in FIG. 2, the inner housing 10 is configured to have a structure in which four terminal accommodation portions 13 are penetratingly formed along a connector fitting direction (direction of an arrow X1 in FIG. 2) by an engagement union of two housing division bodies 20 and 30, that is, the first housing division body 20 and the second housing division body 30.

The four terminal accommodation portions 13 of the inner housing 10, as illustrated in FIG. 1, equals two lines in the width direction in two steps of top and bottom.

The first housing division body 20 and the second housing division body 30 that constitute the inner housing 10 are all made of a resin material.

The two housing division bodies 20 and 30 are provided by dividing the inner housing 10 into two of a front end portion and a rear end portion.

On a front end surface of the first housing division body 20 that constitutes the front end portion of the inner housing 10, openings 13*a* for terminal introduction are formed in two lines in the width direction and in two steps of top and bottom. The openings 13*a* for terminal introduction form the front end portion of the terminal accommodation portion 13.

In the second housing division body 30 that constitutes the rear end portion of the inner housing 10, four terminal accommodation holes 13*b*, which accommodate and hold connection terminals (not illustrated) that are connected to signal lines and drain lines of a shield wire 3 are formed in two lines in the width direction and in two steps of top and bottom. The terminal accommodation holes 13*b* form the rear end portion of the terminal accommodation portion 13.

In this embodiment, the two housing division bodies 20 and 30 are engaged and united through checking them along the connector fitting direction as indicated by an arrow X1 in FIG. 2.

In this embodiment, as means for engaging and uniting the two housing division bodies 20 and 30, two engagement pieces equipped on the first housing division body 20 that is one side of the housing division bodies and two locking portions 32 equipped on the second housing division body 30 that is the other side of the housing division bodies.

As illustrated in FIG. 3, the two engagement pieces 22 are installed on both surfaces of a rib 23 that is integrally formed with the first housing division body 20 one by one. The rib 23 is in the form of a partition which extends along the connector fitting direction between a pair of adjacent openings 13*a* for terminal introduction in the width direction of the first housing division body 20, and is inserted between the adjacent terminal accommodation holes 13*b* in the width direction in the second housing division body 30.

The respective engagement pieces 22 are engagement projections projecting from the rib 23 in the width direction (direction of an arrow Y1 in FIG. 3) of the first housing division body 20, and on the front end surface in the connector fitting direction, a sloping slideway 22*a* is established.

The two engagement pieces 22, integrally with the rib 23, are inserted between the adjacent terminal accommodation holes 13*b* in the width direction in the second housing division body 30. In this embodiment, the two engagement pieces 22, as illustrated in FIG. 3, are installed in two places that are shifted in the fitting direction of the housing division bodies. The dimensions L1 shown in FIG. 3 correspond to a shift amount in the fitting direction of the housing division bodies in the two engagement pieces 22.

The locking portions 32 are equipped between the adjacent terminal accommodation holes 13*b* in the width direction (direction of an arrow Y2 in FIG. 4) in the second housing division body 30 that is the other housing division body. More specifically, between the adjacent terminal accommodation holes 13*b* in the width direction in the second housing division body 30, as illustrated in FIG. 4, a gap 33, into which the rib 23 and the engagement piece 22 can be inserted, is formed along the connector fitting direction.

The gap 33 is formed by a pair of partitions 34 that face each other in the width direction of the second housing division body 30. On the pair of partitions 34, the locking portions 32 are installed so that the respective engagement pieces 22 on the rib 23 are engaged with the locking portions 32 when the rib 23 is completely inserted into the gap 33. In this embodiment, as illustrated in FIG. 4, the locking portions 32 are engaged with the engagement pieces 22 through engagement notch holes to make the housing division bodies in a connection state.

The two locking portions formed on the pair of partitions 34 are shifted in the fitting direction of the housing division bodies in response to the arrangement of the engagement pieces 22 in the first housing division body 20.

The outer housing 40 is approximately in a square tube shape, and is mounted on and fit into the inner housing to cover the circumference of the inner housing 10. The outer housing 40 has a shield structure that electromagnetically shields the circumference of the housing division body 10.

In the connector 1 according to an embodiment of the present invention as described above, the engagement pieces 22 and the locking portions 32, which are the means for engaging and uniting the housing division bodies 20 and 30, complete the engagement in the gap 33 that is a space between the adjacent terminal accommodation portions 13 in the respective housing division bodies 20 and 30.

Accordingly, it is not necessary that the width dimensions of the inner housing 10 is obtained by adding the width dimensions necessary for the engagement of the engagement pieces 22 with the locking portions 32 to both outer sides of the width dimensions necessary for the arrangement of the plurality of terminal accommodation portions. Through this, miniaturization of the connector can be sought by suppressing the external form dimensions of the inner housing 10.

In the connector 1 according to an embodiment of the present invention as described above, since the engagement pieces 22 and the locking portions 32 are engaged in the plurality of places, the big bond strength to which the engagement strength is added can be obtained, and thus the bond strength of the housing division bodies 20 and 30 can be improved. Further, since the plurality of engagement places are shifted in the fitting direction of the housing division bodies 20 and 30, the insertion force that is necessary at the time of the fitting of the housing division bodies 20 and 30 can be reduced to improve the assembling characteristics of the inner housing 10.

The connector according to the present invention is not limited to the above-described embodiments, but appropriate modification and improvement are possible. The materials, shapes, and dimensions of respective components that constitute the connector according to the present invention are arbitrary if they can achieve the purpose of the present invention, and are not limited to the above-described embodiments.

For example, the equipment number of the engagement pieces 22 and the locking portions 32 is not limited to that in the above-described embodiment. Further, on the contrary of the above-described embodiment, the engagement pieces 22 may be provided in the second housing division body 30 and the locking portions 32 may be provided in the first housing division body 20.

Further, the position and the number of divisions when the inner housing is divided into the plurality of housing division bodies are not limited to those in the above-described embodiment. For example, the inner housing may be formed by engaging and uniting three or more housing division bodies. Further, the division of the inner housing is not limited to that in the above-described embodiment in which the inner housing is divided into the plurality of housing division bodies back and force, but the inner housing may be divided into the plurality of housing division bodies up and down.

Further, the shapes and arrangement places of the engagement pieces 22 or the locking portion 32 exemplified in the above-described embodiment are arbitrary if they can achieve the purpose of the present invention, and are not limited to the above-described embodiments.

The present invention is not limited to the above-described embodiment, but appropriate modification and improvement are possible. In addition, the materials, shapes, dimensions, numerals, forms, numbers, and arrangement places of the constituent elements in the above-described embodiment are arbitrary, and are not limited thereto.

Although the present invention has bee described in detail or with reference to specified embodiments, those skilled in the art will appreciate that various modifications or corrections are possible, without departing from the scope and spirit of the invention.

Priority is claimed on Japanese Patent Application No. 2010-194470 filed in the Japan Patent Office on Aug. 31, 2010, the contents of which are incorporated herein by reference.

INDUSTRIAL APPLICABILITY

According to the connector of the present invention, the engagement pieces and the locking portions, which are the means for engaging and uniting the housing division bodies, complete the engagement in the space between the adjacent terminal accommodation portions in the respective housing division bodies.

Accordingly, it is not necessary that the width dimensions of the inner housing is obtained by adding the width dimensions necessary for the engagement of the engagement pieces with the locking portions to both outer sides of the width dimensions necessary for the arrangement of the plurality of terminal accommodation portions. Through this, miniaturization of the connector can be sought by suppressing the external form dimensions of the inner housing.

DESCRIPTION OF REFERENCE NUMERALS

1: Connector
3: Shield Wire
10: Inner Housing
13: Terminal Accommodation Portion
**13*a***: Opening For Terminal Introduction (Terminal Accommodation Portion)
**13*b***: Terminal Accommodation Hole (Terminal Accommodation Portion)
20: First Housing Division Body (Housing Division Body)
22: Engagement Piece
23: Rib
30: Second Housing Division Body (Housing Division Body)
32: Locking Portion
33: Gap
40: Outer Housing

The invention claimed is:

1. A connector comprising:

an inner housing having a plurality of terminal accommodation portions formed therein in a connector fitting direction, the inner housing including a plurality Of housing division bodies that are connected together, and an outer housing that is configured to receive the inner housing to cover a circumference of the inner housing, wherein the connector further comprises, as means for engaging and uniting the plurality of housing division bodies:

engagement pieces equipped on an elongated rib positioning in one of the housing division bodies to be engaged and united, and inserted between adjacent terminal accommodation portions in the other of the housing division bodies; and locking portions positioned on an elongated partition between the terminal accommodation portions in the other of the housing division bodies and engaged with the inserted engagement pieces to connect the plurality of housing division bodies, wherein the engagement pieces and the locking portions are provided in a plurality of places that are shifted in a fitting direction of the housing division bodies to be engaged and united, and wherein the connector fitting direction is a direction that is the same as the fitting direction in which the engagement pieces and locking portions are engaged and united.

2. The connector according to claim 1, wherein the outer housing is configured to electromagnetically shield the circumference of the inner housing.

* * * * *